US006786631B2

(12) United States Patent
Lipp

(10) Patent No.: US 6,786,631 B2
(45) Date of Patent: Sep. 7, 2004

(54) MIXING AND REDUCING MACHINE WITH AN UPWARD CONVEYING MIXING BLADE

(75) Inventor: Eberhard Lipp, Altrip (DE)

(73) Assignee: LIPP Mischtechnik GmbH, Mannheim (DE)

( * ) Notice: Subject to any disclaimer, the term of this patent is extended or adjusted under 35 U.S.C. 154(b) by 0 days.

(21) Appl. No.: 09/858,137

(22) Filed: May 15, 2001

(65) Prior Publication Data

US 2002/0031048 A1 Mar. 14, 2002

(30) Foreign Application Priority Data

May 16, 2000 (DE) ..... 100 23 698

(51) Int. Cl.[7] ..... B01F 7/24

(52) U.S. Cl. ..... 366/322; 366/325.3; 366/330.3

(58) Field of Search ..... 366/325.3, 330.3, 366/65, 67, 266, 293–296, 307, 310, 312, 318, 320, 322, 329.1

(56) References Cited

U.S. PATENT DOCUMENTS

| | | | | |
|---|---|---|---|---|
| 1,500,061 | A | * | 7/1924 | Dimm |
| 1,524,605 | A | * | 1/1925 | White |
| 1,696,994 | A | * | 1/1929 | White |
| 2,227,522 | A | * | 1/1941 | Weigel |
| 3,279,894 | A | * | 10/1966 | Tate et al. |
| 3,675,902 | A | | 7/1972 | Marshall |
| 4,007,016 | A | * | 2/1977 | Weber |
| 4,022,438 | A | * | 5/1977 | Shishido et al. |
| 4,188,132 | A | * | 2/1980 | Lenart et al. |
| 4,274,751 | A | * | 6/1981 | Rector et al. |
| 4,310,124 | A | * | 1/1982 | Schwing et al. |
| 4,460,278 | A | * | 7/1984 | Matsubara et al. |
| 4,515,483 | A | * | 5/1985 | Muller et al. |
| 4,552,461 | A | | 11/1985 | Ott et al. |
| 4,627,735 | A | * | 12/1986 | Rose et al. |
| 5,182,087 | A | * | 1/1993 | Lilja et al. |
| 5,188,808 | A | * | 2/1993 | Lilja et al. |
| 5,382,092 | A | | 1/1995 | Okamoto et al. |
| 5,447,369 | A | * | 9/1995 | Boxall |
| 5,625,008 | A | | 4/1997 | Bronstert et al. |
| 5,683,178 | A | * | 11/1997 | Nakamoto et al. |
| 6,149,296 | A | * | 11/2000 | Asai et al. |
| 6,653,123 | B2 | * | 11/2003 | Horigane |

FOREIGN PATENT DOCUMENTS

| | | | |
|---|---|---|---|
| DE | 10 82 576 | | 6/1960 |
| DE | 3640052 C1 | * | 4/1988 |
| DE | 39 01 552 | | 8/1990 |
| DE | 39015520 A1 | * | 8/1990 |
| DE | 39 21 899 | | 3/1991 |
| DE | 92 08 95 | | 8/1992 |
| EP | 0 063 171 | | 10/1982 |
| EP | 598253 | * | 5/1994 |
| FR | 2 380 067 | | 9/1978 |
| JP | 58-2836 | * | 1/1981 |
| JP | 62-186929 | * | 8/1987 |
| JP | 2-155901 | * | 6/1990 |
| WO | 93/19842 | * | 10/1993 |

* cited by examiner

*Primary Examiner*—Charles E. Cooley
(74) *Attorney, Agent, or Firm*—Harrison & Egbert

(57) ABSTRACT

A mixing and reducing machine with an upward-conveying mixing spiral that rotates around a vertical rotational axle. In order to achieve a more intensive mixing of the mixed product a second mixing spiral is connected in the axial direction after a first mixing spiral, with a transition zone arranged in between. In this way, zones of different axial conveying capacity are connected after each other in the axial direction. The mixing spirals are formed of several mixing blades arranged after each other in the circumferential direction.

9 Claims, 2 Drawing Sheets

MIXING AND REDUCING MACHINE WITH AN UPWARD CONVEYING MIXING BLADE

BACKGROUND OF THE INVENTION

1. Field of the Invention

The present invention involves a mixing and reducing machine with an upward-conveying mixing spiral that rotates around a vertical rotational axle.

2. Description of the Related Art

A machine of this type with two interlocking flat helical springs is known, for example, from the German Patent No. 23 34 789 and German Patent No. 26 38 112. In these previously known mixing and reducing machines, two spirals that mesh with each other are provided. They are mounted on rotating axles that are set apart from each other at a distance to the side. For these rotating axles, between two and four rotary transmission leadthroughs must be provided, depending on the construction, through the cover or the bottom of the container in which the spirals are provided. This container also has an expensive double construction with an essentially figure-eight shaped cross-section. This structural form does indeed make possible an intensive mixing, in which relatively small portions of the mixed good are stirred by the one and then by the other spiral, but is very complicated in its design.

BRIEF SUMMARY OF THE INVENTION

The purpose of the invention presented here is thus to provide a corresponding mixing and reducing machine in which a simpler construction is possible, in which, in particular, the container construction is less complicated, and with which, however, in spite of that, a sufficient mixing quality is achieved.

This purpose is achieved according to the invention in that after the first mixing spiral mentioned, a second mixing spiral is arranged in the axial direction, whereby a transition zone extends between the mixing spirals in the axial direction.

The invention has the advantage that only one rotating axle must be present. This axle can be set in bearings in a correspondingly simple manner with only one or at maximum two rotating embodiments on the container provided. Moreover, the invention has the advantage that although only one rotating axle is present in it, a sufficient intermixing is achieved. This is especially possible in a simple container in the form of a cylinder that can be manufactured in an uncomplicated manner.

In the previously known mixing machines with only one rotating axle, only one mixing spiral is customarily present, and it is continuous. This makes it so that the mixed product is conveyed continuously upwards in the area of the mixing spiral that is radially to the outside relative to the rotating axle, and then—customarily in the area of the centrally arranged rotating axle—drops to the bottom again because of the force of gravity. This does not lead, in the end, to a fast and intensive mixing.

In the embodiment form now proposed according to the invention with two mixing spirals that are connected one after the other in the axial direction and are separated by a transition zone, it is achieved that zones having different axial conveying quantities are connected one after the other, which promotes the intensive intermixing. This is especially the case when the transition zone is free of mixing spirals and the mixed product is thus slowed down at the beginning of the transition zone and is accelerated again at the end of the transition zone through the subsequently connected second mixing spiral. The shearing forces acting as a result in the mixed product lead to a surprisingly intensive mixing.

It should also be mentioned here that for larger systems, several mixing spirals arranged axially behind each other can also be present, each separated by transition zones. For the sake of simplicity, this will not be dealt with separately in the following.

Fundamentally, the two mixing spirals connected axially one after the other, both of which fundamentally convey in the same axial direction upwards, also have different axial conveyed quantities, whereby in the axial direction, an additional shearing gradient occurs, which amplifies the intermixing.

This different axial conveyed quantity can either be achieved in that the two mixing spirals have different helix angles or, however, in that the two mixing spirals have different spiral blade widths.

It is also possible to connect single-flighted or multiple-flighted spirals after each other.

As an additional possibility, to increase the shearing effect in the area of the transition zone, in order to thus increase the mixing effect, it can be provided that the two mixing spirals that are connected one after the other have different rotational speeds or have different rotational directions.

In order to increase the effectiveness of mixing with the spirals, it has proven to be especially favorable if at least one of the spirals provided is interrupted in the circumferential direction and is comprised of mixing blades that are connected after each other in the circumferential direction. Through this type of interruption of the mixing spiral, the mixed product is mixed in an especially intensive manner, since it is moved in especially small volumes by the blades, and comes to rest again. Moreover, each mixing blade can be equipped with a different conveying angle both in the axial and in the radial direction, whereby an additionally improved mixing effect can be obtained.

A further improvement of the intermixing is achieved when at least individual mixing blades have, on their ends that are trailing in the rotating direction, a lifting edge that is bent upwards, through which a brief impulse directed upwards is imparted to a mixed good portion lifted by the mixing blades, before this mixed product portion begins to drop again due to the force of gravity, whereby it is then picked up again by a trailing mixing blade and further intermixed accordingly.

In a special embodiment form of this type of mixing spiral comprised of mixing blades, two mixing blades at a time are arranged essentially above each other are connected to each other by an essentially vertically running blade carrier that is set in the rotational direction. With this blade carrier, on which if necessary, even more than two blades arranged above each other can be mounted, the mixed product can be accelerated or slowed down in the radial direction.

This is possibly further amplified because the mixing blades (and/or the blade carrier that connects them) are attached through carrier arms to a central shaft, the front surface of which is chamfered increasingly, at least in sections, radially to the outside. This also increases a mixing effect in the radial direction of the otherwise only vertically operating mixer.

In order to further intensify the mixing effect, at least individual mixing blades can additionally mesh on their outer side with catchment elements located on the container wall. Through the shearing that occurs in the area of the catchment elements, the mixing effect is greatly increased.

In the process, the catchment elements can involve both closed ring elements as well as toothed ring elements that are mounted on the container wall. These ring elements can in the process either be arranged only in segments over the circumference of the container or, instead over its entire circumference.

An additional improvement of the mixing effect is obtained when on one end of the mixing blades a shearing head is arranged essentially aligned with the vertical rotating axle, with which the mixed good that is dropping centrally around the rotating axle is again sheared. Also, a desired radial or axial conveyance of the mixed good can be influenced here. Advantageously, this shearing head acts together with a counter head, which has a different rotational speed and/or direction.

1BRIEF DESCRIPTION OF THE SEVERAL VIEWS OF THE DRAWINGS

Additional advantages and characteristics of the invention result from the following drawings of an embodiment example.

DESCRIPTION OF THE INVENTION

Figure 1:
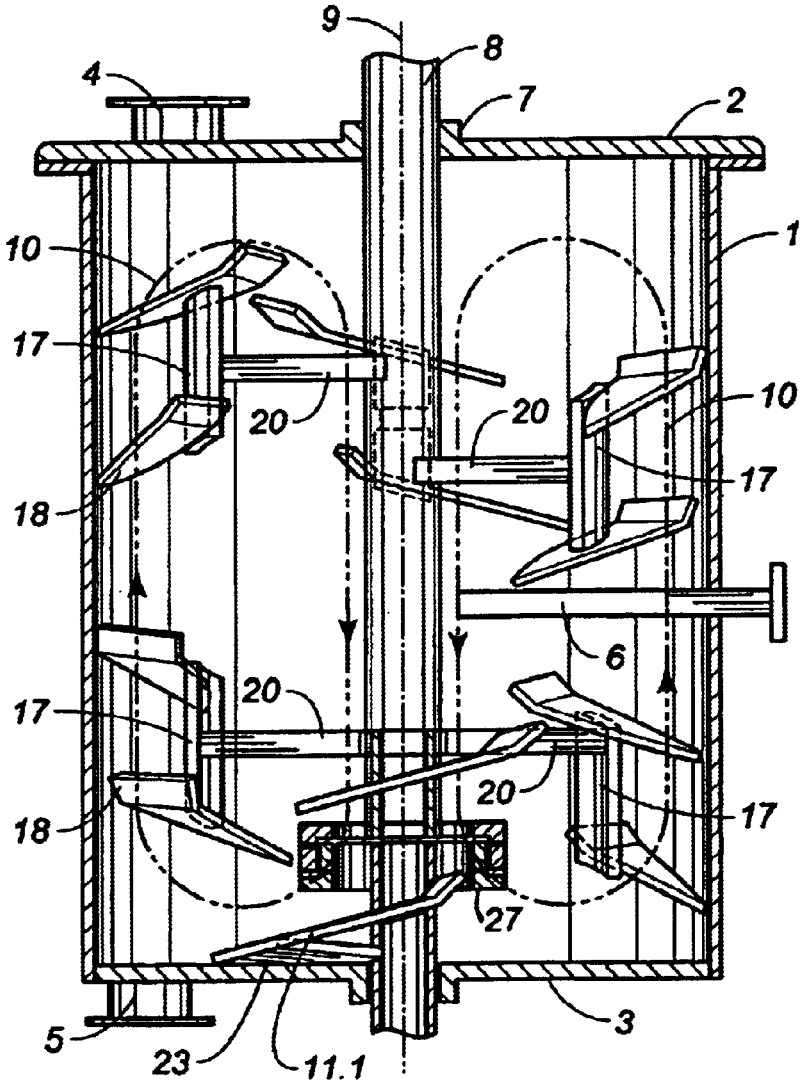
FIG. 1 is a sectional view of a mixing and reducing machine according to the invention.

FIG. 1 shows a mixing and reducing machine according to the invention in the crosssectional view.

A drum-shaped housing 1 is shown which has a cylindrical shape and is closed by a cover 2 that is screwed on and a welded-on bottom 3.

In the cover 2, a feed opening 4 is located. In the bottom 3, an outlet opening 5 for the material to be mixed is located.

Furthermore, in the example depicted here, an additional supply lance 6 is depicted, by which liquid that is yet to be mixed in during the mixing operation can be possibly added to the mixed product that is filled through the supply opening 4.

In the cover 2, a shaft 8 is conducted into the housing 1 on a shaft leadthrough 7, the vertical rotating axle 9 of which coincides with the middle axle of the housing 1.

On this shaft 8, two mixing spirals that convey upwards are mounted above each other. With them, the mixed product is revolved in the vertical mixer as indicated by the dot-dash lines 10: on the circumferential area of the housing 1, the mixed product is conveyed upwards through the two mixing spirals and drops down again in the vicinity of the shaft 8, in particular, also because of the force of gravity.

Figure 2:
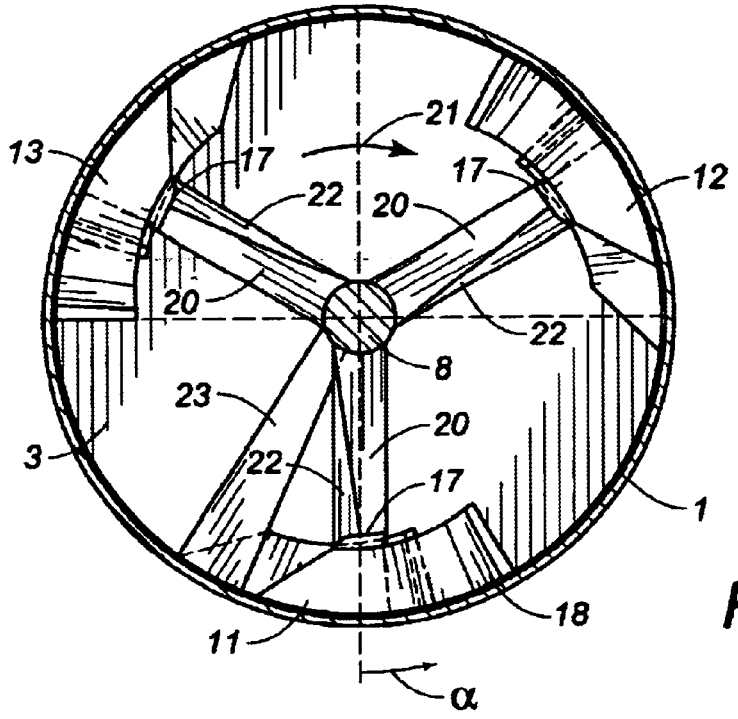
FIG. 2 is a top view of a reducing machine that mixes according to the invention.
Figure 3:
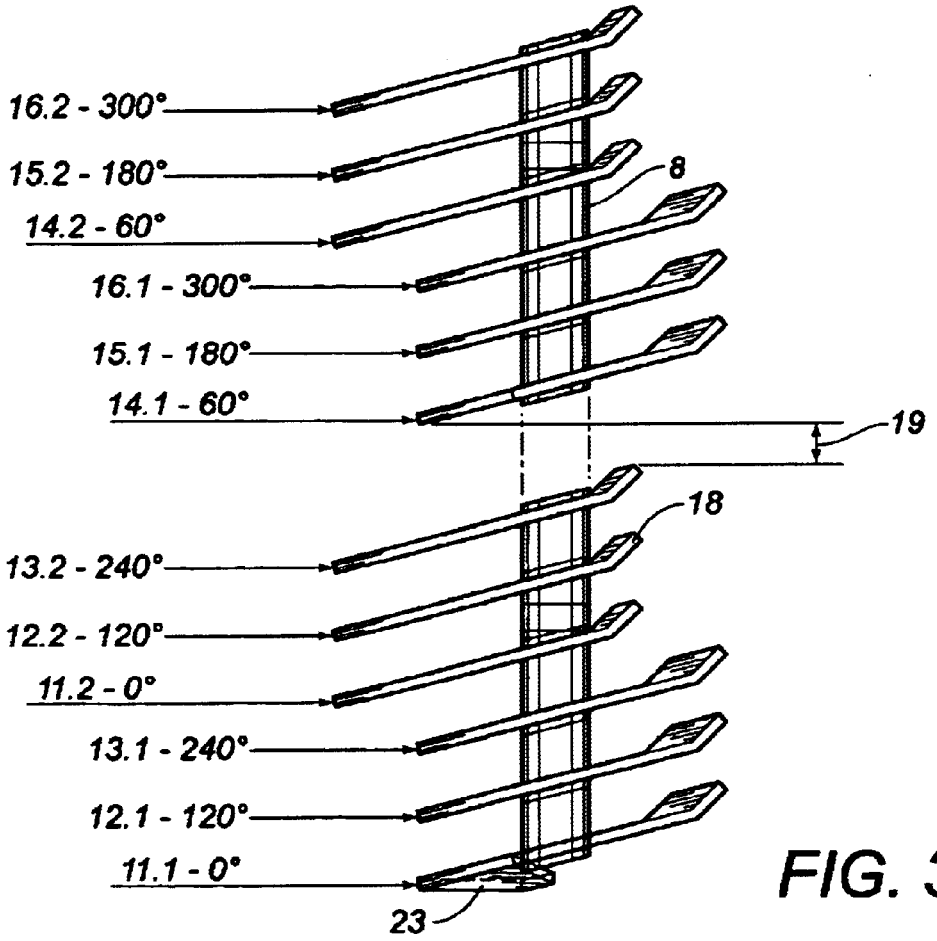
FIG. 3 is a diagrammatic illustration showing the arrangement of mixing spirals that are comprised of mixing blades.

The mixing spirals are, as can be recognized in the view in FIG. 2, not continuous, but instead they are interrupted in the circumferential direction and are comprised of several mixing blades 11 to 13 that are connected one after the other in the circumferential direction. FIG. 3 shows schematically how the individual mixing blades are arranged. In FIG. 2, a zero-line is marked for this purpose, starting from which an angle $\alpha$ is measured. The first mixing blade 11.1 is arranged at an angle of $\alpha=0°$, after which the mixing blade 12.1 is arranged at an angle of $\alpha=120°$, which is in turn followed by the mixing blade 13.1 at an angle of $\alpha=240°$. A small portion of the mixed product is grasped by the first mixing blade and correspondingly conveyed axially and radially and again released. Each subsequent mixing blade picks up parts of this conveyed portion and conveys and mixes it further.

Each of these mixing blades has on its end that is trailing in the rotational direction, a lifting edge 18 that is angled upwards. Through it, a portion of the mixed product, which was lifted by the mixing blade, is given a slight impulse upwards, before it drops again slightly because of the force of gravity, and is picked up by the following mixing blade and conducted again further upwards.

Each of these mixing blades has on its end that is trailing in the rotational direction, a lifting edge 18 that is angled upwards. Through it, a portion of the mixed good, which was lifted by the mixing blade, is given a slight impulse upwards, before it drops again slightly because of the force of gravity, and is picked up by the following mixing blade and conducted again further upwards.

It is now essential to the invention that the mixing blade 13.2 shown is not directly followed a by another mixing blade (in the example shown here, 14.1), but instead that here a transition zone 19 extends in the axial direction, which is free of a mixing spiral in the example shown here. In other words, in this area, the mixed product that was conveyed until now is again brought to rest, before it is picked up by the following other mixing blades 14.1, 15.1 and 16.1 and/or then 14.2, 15.2 and 16.2, which are positioned at circumferential angles of $\alpha=60°$, 180°, or 300°.

In the transition zone 19, liquid can also be added through the supply lance 6 to the mixed good, in order to set a desired viscosity of the mixed material. A liquid supply of this type can if necessary, also be done centrally through the shaft 8 that is then designed to be hollow, or from below, which is also not shown.

It should also be pointed out here that the blade carriers 17 mentioned are set opposite the rotation direction, in order to support a mixed product transport in the radial direction, which favorably affects the mixing. In the example depicted here, these blade carriers 17 are mounted in the process via carrier arms 20 onto the shaft 8, which has on the side lying in front in the rotating direction (according to the arrow 21 in FIG. 2), a front surface 22 that is increasingly chamfered radially to the outside. Also, in this way, a transport of the mixed product radially to the outside is supported.

Furthermore, it is to be pointed out, that the lowest mixing blade 11.1 is provided with a stripper 23 that strips over the bottom 3 of the housing 1 and lifts up the mixed product that is settling there.

All in all, with the mixing device described, the mixed good can be conducted axially and radially in smaller partial portions, whereby a subsequent mixing blade always picks up and conveys further parts of the mixed product portion that is conveyed from the mixing blade that has previously passed. This stirring of very small portions of the mixed product achieves a fast and intensive intermixing.

It should also be mentioned here that it is possible to equip the two described spirals that are connected one after the other onto the shaft 8 in the axial direction with different conveyor volumes, for example, through different adjustment angles of the mixing blades 11.1/2 to 13.1/2 and/or 14.1/2 to 16.1/2. Also, a different rotating direction of these mixing spirals is possible, whereby then the shaft 8 can be designed in the upper area as a hollow shaft through which an inner shaft passes, with which the lower mixing blade is driven. In the process, however, it would also be possible to drive the lower mixing spiral out of the bottom 3 by its own drive.

For mixing jobs in which the shearing of the mixed product, which can be achieved through the mixing elements described thus far, is no longer sufficient to obtain a homogeneous end product, additional shearing elements are shown in the FIGS. 4 and 5, with which a corresponding vertical mixer according to the invention can be additionally equipped.

In the process, catchment elements 24 are mounted on the wall of the cylinder-shaped housing 1 of the mixing container. The blades 25 that assist this catchment element 24 and that are also conducted close along the cylindrical container wall like the aforementioned mixing blades, form an additional shearing gap with the catchment element 24 on their radially outside end, which reinforces the mixing effect for the vertical mixer. In the process, one or more blades 25 can be driven in mesh over several rings 24 arranged axially above each other. Of course, instead of rings that go completely around the circumference, only segments of them can be mounted. As can be recognized in FIG. 5 in the lower half, the catchment elements can also be constructed as toothed rings 26, which especially further increases the shearing action.

In FIG. 4, it is furthermore recognized that the shaft 8 is set in bearings so that it overhangs above the cover 2, so that the mixing station shaft ends at a greater distance above the container bottom 3. On this lower end of the shaft 8, a shearing head 27 is arranged, which rotates together with the shaft 8. In the process, it is in mesh with a counter-shearing head 28, which is driven through its own drive shaft 29 in the opposite direction, whereby the drive shaft 29 is guided separately through the container bottom 3. Through the shearing head 27 and the counter-shearing head 28, the mixed product that is dropping as described above is additionally mixed again along the shaft 8 via the rotating speed differences, rotating directions, gap widths and diameters of the shearing heads that are predominant here. In this area, the liquid can also be supplied very well, and it is mixed in an especially effective manner.

On the whole, the present invention shows an effective device for ensuring a mixed product preparation operating in the vertical direction, in which the maximum homogeneity requirements can be met while simultaneously keeping the batch times short. The different shearing effects over the zones of the mixer are especially advantageous in the process when liquids are added as mixing components, since in the area of the liquid additions, the increased shearing effect leads to a quick distribution of these components. Since this increased shearing effect only occurs locally, however, the drive output is, on the whole, not increased unnecessarily and the wear is also lowered. Also, fragile solid portions are not destroyed and are not exposed to any non-permitted high temperature increases.

What is claimed is:

1. A mixing and reducing machine comprising:

a housing having an interior volume;

an axle extending vertically within said housing, said axle being rotatably mounted in said housing;

a mixing spiral means affixed to said axle for conveying product upwardly in said housing, said mixing spiral means comprising:

a first spiral-shaped mixing blade affixed to said axle in a first position along a longitudinal axis of said axle and extending radially outwardly therefrom; and a second spiral-shaped mixing blade affixed to said axle in a second position along the longitudinal axis of said axle and extending radially outwardly therefrom, said first position being separated from said second position by a transition zone, said transition zone being passable directly therethrough from said first position to said second position, said first spiral-shaped mixing blade comprises a plurality of blade elements being connected and positioned adjacent each other in a circumferential direction, said second spiral-shaped mixing blade comprises a plurality of blade elements being connected and positioned adjacent each other in a circumferential direction.

2. The machine of claim 1, said blade elements of said first spiral-shaped mixing blade and said blade elements of said second spiral-shaped mixing blade having different capacities for axially conveyed quantities.

3. The machine of claim 1, said blade elements of said first spiral-shaped mixing blade having a helix angle that is different than a helix angle of said blade elements of said second spiral-shaped mixing blade.

4. The machine of claim 1, said blade elements of said first spiral-shaped mixing blade having a blade width that is different than a blade width of said blade elements of said second spiral-shaped mixing blade.

5. The machine of claim 1, said blade elements of said first spiral-shaped mixing blade having, a periphery with a rotational speed that is different than a rotational speed of a periphery of said blade elements of said second spiral-shaped mixing blade.

6. The machine of claim 1, each of said blade elements of said first and second spiral-shaped mixing blades having a lifting edge on a trailing end thereof bent upwardly in a rotational direction.

7. The machine of claim 1, wherein said blade elements are arranged essentially one above another and are connected through a blade carrier set in the rotational direction.

8. The machine of claim 1, wherein said blade elements are attached through carrier arms onto said axle, a front surface thereof being chamfered in sections, increasing radially to said periphery.

9. The machine of claim 1, further comprising a shearing head affixed to a lower said second spiral-shape mixing blade, said shearing head being aligned with said axle.

* * * * *